US007741758B2

(12) United States Patent
Hanai et al.

(10) Patent No.: US 7,741,758 B2
(45) Date of Patent: Jun. 22, 2010

(54) ELECTRON MULTIPLIER INCLUDING DYNODE UNIT, INSULATING PLATES, AND COLUMNS

(75) Inventors: Hiroyuki Hanai, Hamamatsu (JP); Nobuharu Suzuki, Hamamatsu (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 423 days.

(21) Appl. No.: 10/560,785

(22) PCT Filed: Jun. 16, 2004

(86) PCT No.: PCT/JP2004/008442

§ 371 (c)(1), (2), (4) Date: Dec. 14, 2005

(87) PCT Pub. No.: WO2004/112081

PCT Pub. Date: Dec. 23, 2004

(65) Prior Publication Data

US 2006/0232205 A1 Oct. 19, 2006

(30) Foreign Application Priority Data

Jun. 17, 2003 (JP) ..... 2003-172502

(51) Int. Cl.
*H01J 43/00* (2006.01)
*H01J 43/10* (2006.01)

(52) U.S. Cl. ..... 313/103 CM; 313/105 R; 313/105 CM

(58) Field of Classification Search ..... 313/542, 313/103 CM, 105 R, 105 CM; 250/206, 250/214 VT See application file for complete search history.

(56) References Cited

U.S. PATENT DOCUMENTS

| | | | |
|---|---|---|---|
| 2,664,515 | A | 12/1953 | Smith |
| 3,114,044 | A | 12/1963 | Sternglass |
| 5,510,674 | A | 4/1996 | Kyushima et al. |
| 5,841,231 | A | 11/1998 | Kimura et al. |
| 6,380,674 | B1 | 4/2002 | Aida et al. |
| 6,538,399 | B1 | 3/2003 | Shimoi et al. |
| 6,946,641 | B1 | 9/2005 | Shimoi et al. |

FOREIGN PATENT DOCUMENTS

| | | | |
|---|---|---|---|
| EP | 0 911 864 | | 4/1999 |
| EP | 1 282 150 | A1 | 2/2003 |
| GB | 1072276 | | 6/1967 |
| JP | 52-129369 | A | 10/1977 |
| JP | 61-82646 | A | 4/1986 |
| JP | 62-287560 | A | 12/1987 |
| JP | 05-325878 | A | 12/1993 |
| JP | 08-007825 | A | 1/1996 |
| JP | 09-045275 | * | 2/1997 |
| JP | 09-045275 | A | 2/1997 |
| JP | 9-306416 | | 11/1997 |
| JP | 2000-003693 | A | 1/2000 |

* cited by examiner

*Primary Examiner*—Karabi Guharay
(74) *Attorney, Agent, or Firm*—Drinker Biddle & Reath LLP

(57) ABSTRACT

A venetian blind dynode 5A and metal channel dynodes 5B of a dynode unit 5 are fitted along with insulating spacers (insulating plates) 11 on columns 9 erected on a stem plate 3 that makes up a vacuum container, and since in this state, venetian blind dynode 5A, metal channel dynodes 5B, and insulating spacers (insulating plates) 11 are supported integrally and firmly by columns 9, venetian blind dynode 5A, metal channel dynodes 5B, and insulating spacers (insulating plates) 11 will not undergo inadvertent lateral deviation due to vibration or impact and dynode unit 5 exhibits an excellent anti-vibration effect.

4 Claims, 2 Drawing Sheets

ELECTRON MULTIPLIER INCLUDING DYNODE UNIT, INSULATING PLATES, AND COLUMNS

TECHNICAL FIELD

This invention relates to an electron multiplier comprising a dynode unit, wherein a plurality of dynodes are positioned in a layered state in multiple stages.

BACKGROUND ART

As a dynode unit of an electron multiplier, an arrangement, wherein a plurality of dynodes are positioned in a layered state in multiple stages, is generally known (see, for example, Patent Document 1). In an electron multiplier equipped with this type of dynode, a plurality of stem pins, for supplying control voltages to the respective dynodes, are fixed in a penetrating manner in a stem plate that makes up a vacuum container of the electron multiplier, and by the tip portions of the respective stem pins being fixed to peripheral portions of the respective dynodes, the plurality of dynodes are supported in multiple stages in a mutually parallel manner (see, for example, Patent Document 2).

Here, with the electron multiplier described in Patent Document 2, in order to keep uniform the mutual intervals of the plurality of dynodes that are supported in multiple stages, microscopic insulation balls are interposed between opposing surfaces of the respective dynodes. The insulating balls are fitted into tapered-hole-like recesses, which are formed on the opposing surfaces of the dynodes, and are thereby prevented from falling off.

Patent Document 1: Japanese Published Unexamined Patent Application No. 2000-3693 (FIG. 1)

Patent Document 2: Japanese Published Unexamined Patent Application No. H8-7825 (FIG. 1)

DISCLOSURE OF THE INVENTION

Problems to be Solved by the Invention

With an electron multiplier of a conventional example described in Patent Document 1 or Patent Document 2, when a strong vibration or impact is applied to the dynode unit, the stem pins may bend and the respective dynodes may undergo lateral deviation with respect to each other. Thus, depending on the usage environment, the anti-vibration performance may be inadequate.

An object of this invention is thus to provide an electron multiplier equipped with a dynode unit of excellent anti-vibration performance.

Means for Solving the Problem

This invention's electron multiplier comprises: a dynode unit, having a plurality of dynodes positioned in a mutually-insulated, layered state in multiple stages and disposed in a vacuum container; a plurality of insulating plates, insulating the respective dynodes from each other; and columns, erected on a stem plate, making up the vacuum container, so as to fit or engage with the respective dynodes and the respective insulating plates; and is characterized in that the respective dynodes and the respective insulating plates are overlapped alternatingly in the state of being fitted or engaged with the columns and the respective dynodes and the respective insulating spacers are supported integrally on the columns by means of arresting members being fixed to the tip portions of the columns.

With this invention's electron multiplier, since the respective dynodes and the respective insulating plates of the dynode unit are fitted or engaged with the columns erected on the stem plate that makes up the vacuum container, and the respective dynodes and the respective insulating plates are integrally and firmly supported by the columns in this state, the respective dynodes and the respective insulating plates will not undergo inadvertent lateral deviation due to acceleration or impact and the dynode unit exhibits an excellent anti-vibration effect.

EFFECTS OF THE INVENTION

By this invention's electron multiplier, since the respective dynodes and the respective insulating plates of the dynode unit are fitted or engaged with the columns erected on the stem plate that makes up the vacuum container, and the respective dynodes and the respective insulating plates are integrally and firmly supported by the columns in this state, the respective dynodes and the respective insulating plates will not undergo inadvertent lateral deviation due to vibration or impact and the dynode unit exhibits an excellent anti-vibration effect.

DESCRIPTION OF THE SYMBOLS

1 . . . side tube, 2 . . . light receiving surface plate, 3 . . . stem plate, 4 . . . focusing electrode, 5 . . . dynode unit, 5A . . . venetian blind dynode, 5A1 . . . mounting hole, 5B . . . metal channel dynode, 5B1 . . . mounting hole, 6 . . . anode, 6A . . . mounting hole, 7 . . . sealing ring, 8 . . . exhaust tube, 9 . . . column, 10 . . . insulating collar, 11 . . . insulating spacer (insulating plate), 12 . . . insulating ring, 13 . . . insulating ring, 14 . . . nut.

BEST MODES FOR CARRYING OUT THE INVENTION

An embodiment of this invention's electron multiplier shall now be described with reference to the drawings. In regard to the referred drawings, FIG. 1 is a longitudinal sectional view of the internal structure of an electron multiplier of an embodiment, and FIG. 2 is a perspective view of the principal components of the dynode unit shown in FIG. 1.

Figure 1:
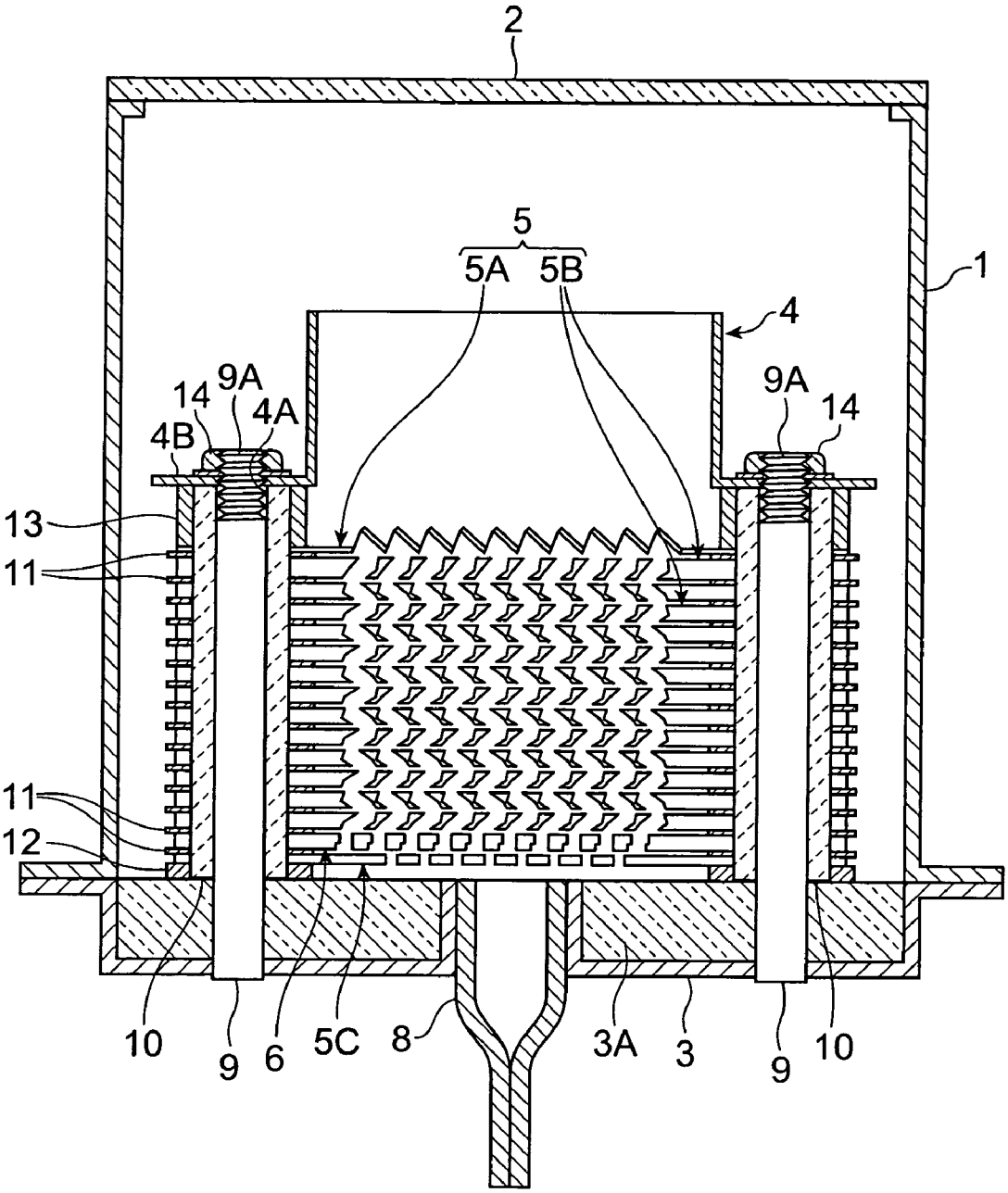
FIG. 1 A longitudinal sectional view of the internal structure of an electron multiplier of an embodiment of this invention.
Figure 2:
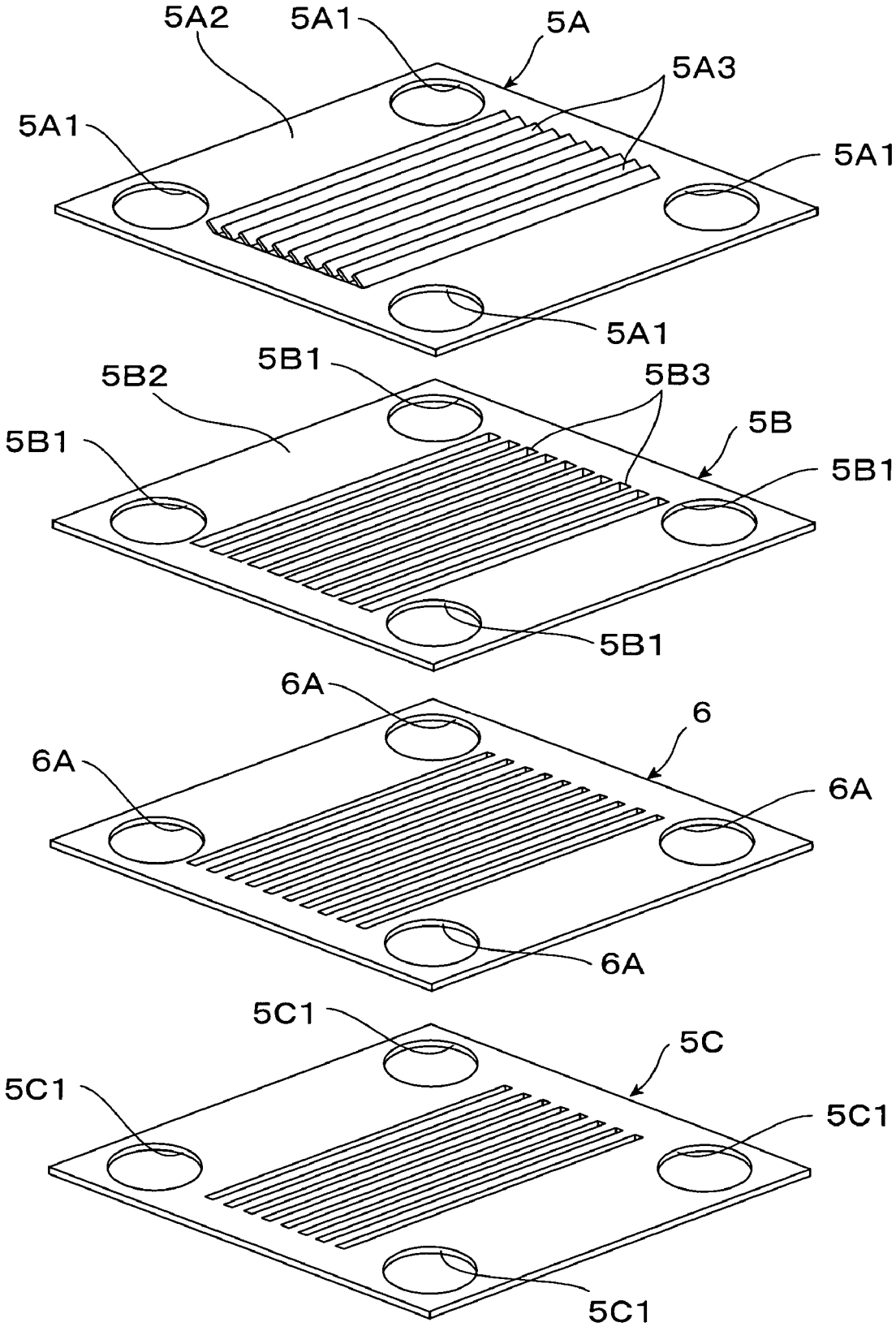
FIG. 2 is a perspective view of the principal components of the dynode unit shown in FIG. 1.

As shown in FIG. 1, the electron multiplier of the embodiment is, for example, arranged as a head-on PMT (photomultiplier), wherein a focusing electrode 4, a dynode unit 5, an anode 6, etc., are housed inside a vacuum container of a structure, with which a light receiving surface plate 2 is fixed in an airtight manner onto an opening at one end of a cylindrical side tube 1 and a stem plate 3 is fixed in an airtight manner onto an opening at the other end.

Side tube 1 is arranged as a Kovar metal tube, having flanges formed at both ends, and the peripheral edge portion of light receiving surface plate 2 is thermally fused onto the flange at one end and a flange of stem plate 3 is joined by welding to the flange at the other end.

Light receiving surface plate 2 is formed of circular Kovar glass with a thickness, for example, of approximately 0.7 mm and a photoelectric surface (not shown) is formed on the inner surface of the portion that opposes a light incidence window.

The material of light receiving surface plate 2 may be changed as suited in accordance with the required light transmitting characteristics to synthetic quartz, UV glass, borosilicate glass, etc.

Stem plate 3 is formed of Kovar metal and the interior is formed to a dish-like form that is filled with an insulating sealing member 3A, formed of borosilicate glass. An unillustrated plurality of stem pins are passed through stem plate 3 in an airtight manner and connected to the respective dynodes of a dynode unit 5. An exhaust tube 8, for drawing vacuum from the interior of the vacuum container, is fitted and fixed in an airtight manner to a central portion of stem plate 3 and an outer end portion thereof is closed off.

For example, four columns 9, for firmly supporting focusing electrode 4, the dynodes of the respective stages of dynode unit 5, and anode 6, are erected on stem plate 3. Each column 9 is embedded in an airtight manner in insulating sealing member 3A with its base end portion passing through stem plate 3. An insulating pipe 10 is fitted onto each column 9.

Focusing electrode 4 is formed to a short, circular cylindrical (or rectangular cylindrical) form with a flange portion 4B, having formed therein mounting holes 4A into which the respective columns 9 are fitted, and is positioned at the inner side of side tube 1 with its opening directed toward light receiving plate 2.

Here, with dynode unit 5, for example the dynode of the first stage is arranged as a venetian blind dynode 5A, and the dynodes of the second stage onward, for example, to a fourteenth stage, are arranged as metal channel dynodes 5B.

As shown in FIG. 2, venetian blind dynode 5A has a plurality of louver-like electrode elements 5A3 that are cut and raised at an angle of substantially 45 degrees from a substrate 5A2, having mounting holes 5A1, into which the respective insulating pipes 10 (see FIG. 1) are fitted, formed at four corners. The respective electrode elements 5A3 are parallel and adjacent to each other and are inclined in the same direction, thereby exhibiting the appearance of blinds as a whole.

On the outer surface of each electrode element 5A3 that faces the light receiving surface plate 2 side is formed a secondary electron emitting surface, which receives electrons, emitted from the photoelectric surface of light receiving surface plate 2 and converged by focusing electrode 4, and emits secondary electrons resulting from multiplication of the received electrons.

With venetian blind dynode 5A of such a structure, since the secondary electron emitting surfaces of the respective electrode elements 5A3 are adjacent each other and secure a wide area as whole, the photoelectron collection efficiency is high and more secondary electrons can be emitted to metal channel dynode 5B of the second stage.

Each metal channel dynode 5B has a plurality of through holes 5B3, opened in slit-like form in a substrate 5B2, having mounting holes 5B1, into which the respective insulating pipes 10 (see FIG. 1) are fitted, formed at four corners. The respective through holes 5B3 extend parallel to each other and in alignment with the respective electrode elements 5A3 of venetian blind dynode 5A.

Each through hole 5B3 has an inner wall surface of inclined cross-sectional shape such that the opening width at the emitting side is wider than the opening width at the secondary electron collecting side (see FIG. 1), and on the inner wall surface thereof is formed a secondary electron emitting surface, which multiplies the secondary electrons, made incident from the collecting side, and emits the multiplied electrons.

Here, as shown in FIG. 1, venetian blind dynode 5A of the first stage and metal channel dynodes 5B of the second to fourteenth stages of dynode unit 5 are supported in multiple stages along with anode 6 and dynode 5C of the final stage in a mutually insulated, layered state.

As a structure for this arrangement, mounting holes 6A and mounting holes 5C1, into which the respective insulating pipes 10 (see FIG. 1) are fitted, are respectively formed in the four corners of anode 6 and dynode 5C of the final stage as shown in FIG. 2. Also, as shown in FIG. 1, a plurality of washer-like insulating spacers (insulating plates) 11 and a plurality of insulating rings 12 and 13, which are fitted onto the respective pipes 10, are provided and a plurality of nuts 14, which are screwed onto male thread portions 9A formed on the tip portions of the respective columns 9, are provided.

By fitting insulating rings 12, mounting holes 5C1 of dynode 5C of the final stage, insulating spacers 11, mounting holes 6A of anode 6, and insulating spacers (insulating plates) 11 in that order onto the respective insulating pipes 10, then fitting mounting holes 5B1 of metal channel dynodes 5B and insulating spacers (insulating plates) 11 alternatingly onto the respective insulating pipes 10, and then fitting mounting holes 5A1 of venetian blind dynode 5A and insulating rings 13 onto the respective insulating pipes 10, venetian blind dynode 5A of the first stage and metal channel dynodes 5B of the second to fourteenth stages are positioned in multiple stages along with anode 6 and dynode 5C of the final stage in a mutually insulated, layered state.

Here, the tip portions of the respective columns 9 are fitted into the respective mounting holes 4A formed in flange portion 4B of focusing electrode 4, and by the respective nuts 14, screwed as arresting members onto male thread portions 9A formed on the tip portions of the respective columns 9, pressing insulating rings 13 via flange portion 4B of focusing electrode 4, focusing electrode 4, venetian blind dynode 5A of the first stage, metal channel dynodes 5B of the second to fourteenth stages, anode 6, and dynode 5C of the final stage are supported integrally and firmly along with the respective insulating spacers (insulating plates) 11 by the respective columns 9.

With the electron multiplier of the embodiment that is arranged as described above, when light to be measured is illuminated onto light receiving surface plate 2, the photoelectric surface on the rear side emits photoelectrons and the emitted photoelectrons are converged onto venetian blind dynode 5A of the first stage by the actions of focusing electrode 4.

Here, with venetian blind dynode 5A of the first stage, since the secondary electron emitting surfaces of the respective electrode elements 5A3 are adjacent each other and secure a wide area as a whole, the photoelectrons, converged by focusing electrode 4, are collected efficiently and multiplied and the multiplied secondary electrons are emitted toward metal channel dynode 5B of the second stage.

Metal channel dynodes 5B of the second to fourteenth stages successively and efficiently multiply the secondary electrons that are collected efficiently and multiplied by venetian blind dynode 5A of the first stage.

The secondary electrons that are multiplied by metal channel dynodes 5B of the second to fourteenth stages are detected efficiently as an electrical signal by means of anode 6.

With the electron multiplier of the embodiment, since the dynodes of the second to fourteenth stages of dynode unit 5 are arranged from metal channel dynodes 5B, with which the layered state can be made thin, the total length in the direction of layering of dynode unit 5 can be made short and compact.

With the electron multiplier of the embodiment, insulating pipes 10 are respectively fitted onto the plurality of columns 9 erected on stem plate 3 that makes up the vacuum container and the respective mounting holes 5A1 of venetian blind dynode 5A, the respective mounting holes 5B1 of metal channel dynodes 5B, and the respective insulating spacers (insulating plates) 11 that make up the dynode unit 5 are fitted to the respective insulating pipes 10. In this state, venetian blind dynode 5A, metal channel dynodes 5B, and insulating spacers (insulating plates) 11 are integrally and firmly supported by columns 9.

Thus with the electron multiplier of the embodiment, venetian blind dynode 5A, metal channel dynodes 5B, and insulating spacers (insulating plates) 11 will not undergo inadvertent lateral deviation due to vibration or impact and dynode unit 5 exhibits excellent anti-vibration performance.

Whereas with an electron multiplier of a conventional example, the anti-vibration performance was 1000 $m/s^2$, with the electron multiplier of the embodiment, the anti-vibration performance improved to 3000 $m/s^2$ or triple that of the conventional example.

This invention's electron multiplier is not restricted to the embodiment. For example, with dynode unit 5, the dynodes of all stages may be arranged from metal channel dynodes or from venetian blind dynodes.

Also, insulating spacer (insulating plate) 11 is not restricted to being of washer-like form and may be formed to a rectangular ring-like form having mounting holes formed at four corners.

Also, in place of nuts 14 screwed onto the tip portions of the respective columns 9, suitable arresting members may be adhered or welded onto the tip portions of the respective columns 9.

Also, this invention's electron multiplier may be an electron multiplier that does not have a photoelectric surface.

INDUSTRIAL APPLICABILITY

With this invention, since the respective dynodes and the respective insulating plates of the dynode unit are fitted or engaged with the columns erected on the stem plate that makes up the vacuum container, and the respective dynodes and the respective insulating plates are integrally and firmly supported by the columns in this state, an electron multiplier can be provided with which the respective dynodes and the respective insulating plates will not undergo inadvertent lateral deviation due to vibration or impact and the dynode unit exhibits an excellent anti-vibration effect.

The invention claimed is:

1. An electron multiplier comprising:

a dynode unit, having a plurality of dynodes positioned in a mutually-insulated, layered state in multiple stages and disposed in a vacuum container;

an anode housed inside the vacuum container;

a plurality of insulating plates, insulating the respective dynodes from each other; and columns, erected from a stem plate, making up the vacuum container, so as to fit or engage with the respective dynodes, anode, and the respective insulating plates, wherein the respective dynodes and the respective insulating plates are overlapped alternating in the state of being fitted or engaged with the columns and the respective dynodes and the respective insulating plates are supported integrally on the columns by means of arresting members being fixed to the tip portions of the columns, wherein a rear edge of each respective column is fixed to the stem plate and the arresting members are fixed to a front edge of each respective column, wherein an insulating part is provided so as to surround each respective column in the area near the rear edge so that each dynode, anode, and insulating plate are stacked on the insulating part, wherein the stem plate includes a metallic plate-shaped material structurally configured into a concave shape, the concave shape being filled-in with an insulating sealing member so that each respective column is erected through the stem plate and is embedded in the insulating sealing member, and wherein the insulating part, which is configured so as to surround each respective column, is disposed so as to be in direct contact with a top surface of the stem plate.

2. An electron multiplier as claimed in claim 1, wherein the insulating part is an insulating ring that is fit or engaged near the rear edge section of each respective column.

3. An electron multiplier as claimed in claim 1, further comprising an insulating pipe that is fitted onto each respective column.

4. An electron multiplier as claimed in claim 1, further comprising a male thread portion formed on a pointed end of each respective column, and a nut is fixed on the male thread portion as an arresting member, respectively.

* * * * *